United States Patent [19]

Gatilao

[11] 4,130,212

[45] Dec. 19, 1978

[54] MULTIPLE HEAD DRUM LIFT UNIT

[75] Inventor: Lamberto S. Gatilao, Chicago, Ill.

[73] Assignee: Liftomatic Material Handling, Inc., Evanston, Ill.

[21] Appl. No.: 791,040

[22] Filed: Apr. 26, 1977

[51] Int. Cl.[2] ..... B66F 9/18

[52] U.S. Cl. ..... 214/653; 214/620; 214/654

[58] Field of Search ..... 214/653, 654, 383, 655, 214/620, DIG. 1, DIG. 3, DIG. 4, DIG. 10, 330, 333, 380–382, 384, 302, 147 R, 147 G, 650 R, 650 S, 650 G, 651, 652; 294/90.87 R, 27–31

[56] References Cited

U.S. PATENT DOCUMENTS

| | | | |
|---|---|---|---|
| 2,347,212 | 4/1944 | Naranick | 294/28 |
| 2,698,107 | 12/1954 | Ericson | 214/653 |
| 3,223,265 | 12/1965 | Hansen | 214/650 R |
| 3,367,705 | 2/1968 | Ames | 214/650 SG X |
| 3,510,019 | 5/1970 | Howard | 214/620 |

*Primary Examiner*—Frank E. Werner

*Attorney, Agent, or Firm*—Hill, Gross, Simpson, Van Santen, Steadman, Chiara & Simpson

[57] ABSTRACT

Multiple head drum clamping attachment for attachment to a lifting device such as a lift truck for lifting and transporting barrels or drums and particularly lightweight fiber drums having beads extending about each end thereof. The clamping attachment comprises a transverse bar having clamping heads pivotally mounted on each end for limited pivotal movement about parallel vertical axes to conform the clamping head to the contour of the drum. The transverse bar may be supported on the vertical mast of a lift truck on pairs of parallel spaced links attached to a universal support, supporting the transverse bar for limited movement in vertical and horizontal planes relative to the links to conform the clamping attachments to a selected drum and its top bead. The links are biased outwardly with respect to the mast and the clamping attachments each include a casing and clamping jaws carried in the casing. Engagement of the lower clamping jaw with the drum and upward lifting movement thereof brings the lower of said jaws under the bead of the drum and the upper of the jaws within the bead of the drum to effect upward lifting movement of the drum upon upward movement of the mast. Stops are provided to limit outward pivotal movement of the clamping attachments about vertical axes and to assure that the clamping attachments conform to drums of varying diameters and to beads of various forms and lift a selected drum without damaging its bead.

8 Claims, 6 Drawing Figures

Fig. 1
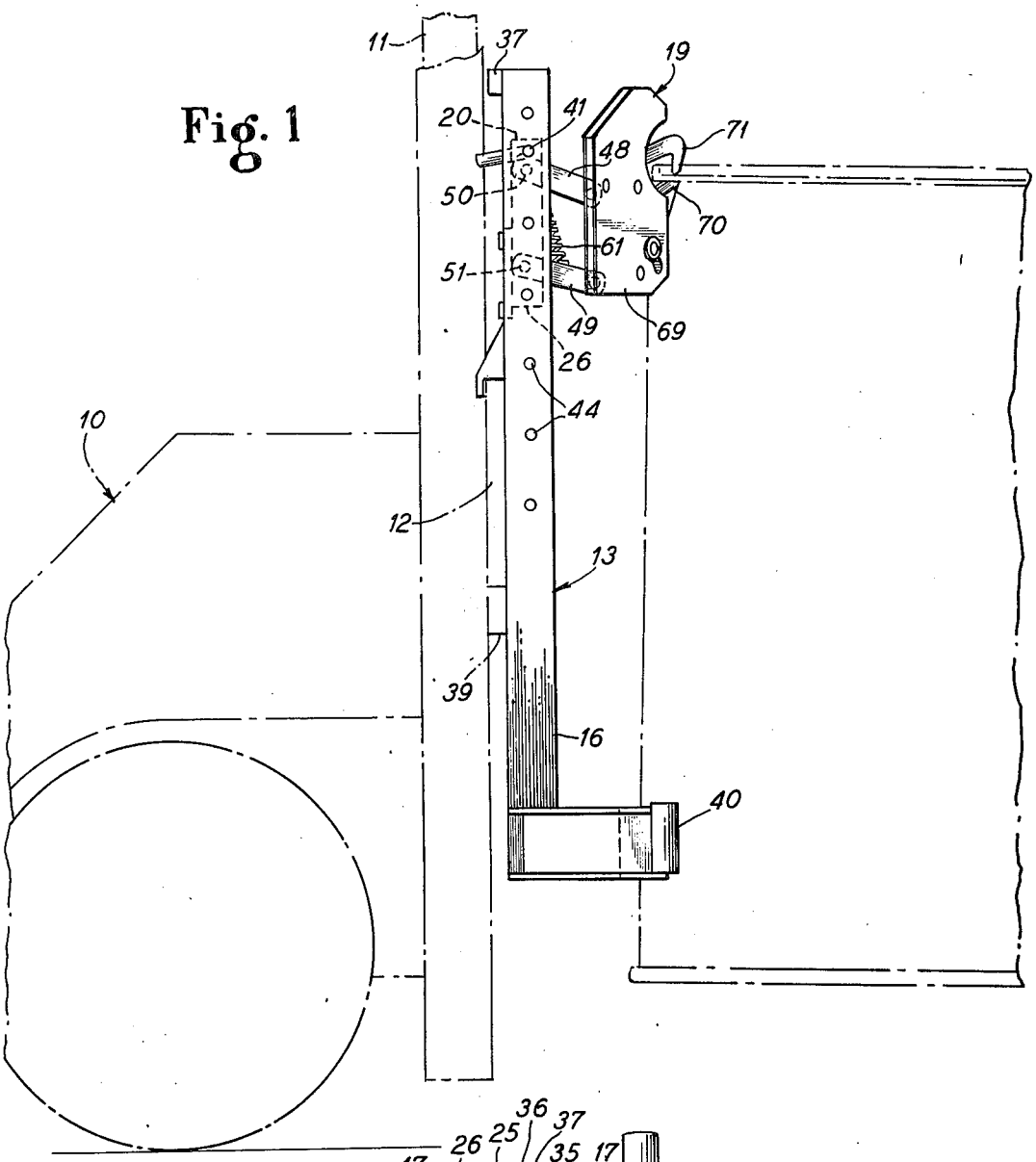
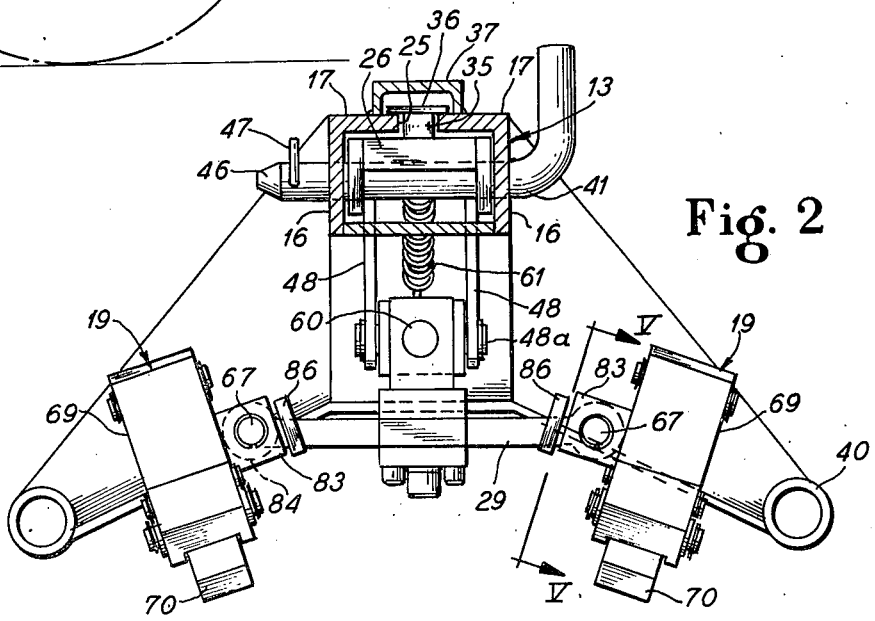
Fig. 2

MULTIPLE HEAD DRUM LIFT UNIT

PRIOR ART

The Patents to Ericson Nos. 2,698,107; 2,814,403 and 3,338,616 accompanying this application illustrate gripping attachments which have come into common use for picking up and transporting drums and barrels. Applicant's assignee further has manufactured double clamping units fixedly mounted on opposite ends of a transverse bar for picking up and transporting heavy steel drums.

Fiber drums, however, have come into common use because lighter than steel drums and the beads of such drums are readily injured by the jaws of the clamping heads when pickup up by a single clamping head as illustrated in the prior art patents mentioned above or by double clamping heads fixedly mounted on each end of a transverse bar. Such units also must be designed for uniform diameter drums and are not adapted for picking up light fiber drums without injuring the beads of the drums and cannot conform to a drum of a non-uniform periphery.

SUMMARY AND ADVANTAGES OF INVENTION

The device of my present invention improves upon the drum clamping and lifting devices of the foregoing prior art in that two clamping attachments at opposite ends of a transverse bar are automatically adapted to conform to and grip and lift drums of varying peripheries and having beads of varying forms, and particularly fiber drums, without damaging the beads thereof.

A further advantage of the invention is the improvement upon multiple clamping device lifts, in that the clamping devices are mounted to conform to the outer contour of the beads of the drums lifted, and to thereby avoid tearing the beads when lifting the drum.

A still further advantage of the invention is in the pivotal mounting of a pair of drum clamping devices on opposite ends of a transverse bar, and in limiting pivotal movement of the clamping devices to prevent the clamping devices from coming out of position to engage the beads of a drum as moved inwardly toward the drum to be lifted.

A further advantage of the invention is in the universal support for the clamping devices, supporting the two clamping devices to readily conform to the periphery and top bead of a drum without injuring the drum.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF THE DRAWINGS

FIG. 1 is a view in side elevation of a drum handling attachment constructed in accordance with the principles of the present invention, showing the attachment mounted on a vertically movable mast of an industrial lift truck, shown in phantom, and supporting a drum in spaced relation with respect to the ground;

FIG. 2 is a top plan view of the drum gripping and lifting attachments of the present invention with the attachments separated from the mast of the lift truck;

DESCRIPTION OF THE PREFERRED EMBODIMENT

Figure 3:
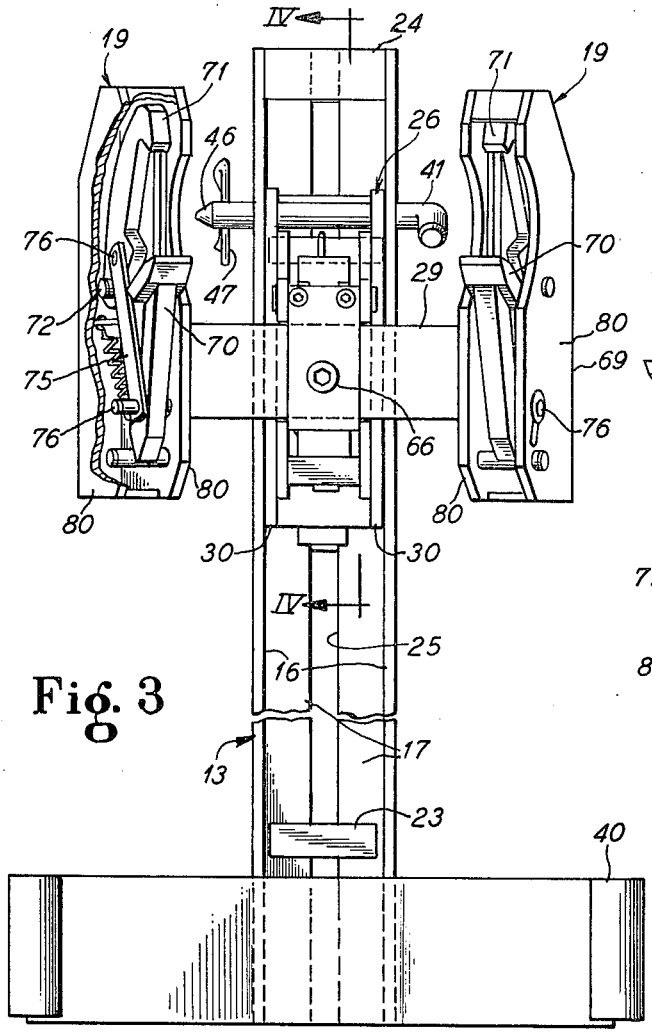
FIG. 3 is a front end view of the gripping and lifting attachments shown in FIG. 2.

In the embodiment of the invention illustrated in the drawings, I have shown by broken lines in FIG. 1, a power-operated truck 10 of an industrial type commonly used to transport material from place to place and to lift the same for stacking. The truck 10 is shown for illustrative purposes only, and is no part of the present invention except insofar as the gripping attachments of my invention may be attached to the mast of the lift truck and lifted by said mast to grip the bead of a drum and lift and transfer the drum to a desired location as the lift truck is moved to the desired location, so not herein shown or described in detail. As herein shown, the truck 10 has a vertically movable mast 11 guided at its forward end thereof in a conventional manner and moved vertically, preferably by hydraulic motors (not shown) operatively connected with said mast in a manner well-known to the art, so not herein shown or described in detail.

The mast 11 has a transverse lift bar 12 adapted to support a supporting frame structure 13 for drum gripping and lifting attachments 19 for holding said gripping attachments in a selected position and lifting or lowering the same upon vertical movement of said lift bar. The mast, lift bar and supporting frame structure are conventional, as shown in U.S. Pat. Nos. 2,698,107 and 2,814,403, the disclosures of which are incorporated herein so need not be described further.

The supporting frame structure 13, however, will be described insofar as necessary to show the mounting of the gripping attachments thereto. Said supporting frame structure includes a pair of facing parallel angle irons having legs 16 which face each other and form a guide and support for a slide 26 supporting a pair of gripping attachments 19. The legs 16 terminate into right-angled legs 17 spaced apart to form a vertical guide slot 25 for the slide 26.

The legs 17 are spaced apart by spacers 23 and 24 (FIG. 3) to form the vertical guide slot 25 extending therealong and retainer means for the slide 26 slidably guided for movement along said supporting frame structure.

The slide 26 is shown as comprising a pair of parallel plates 30 extending parallel to the legs 16 of the angle irons and spaced inwardly therefrom to readily slide along the guide formed by the supporting frame structure 13. The parallel plates 30 are connected together at their upper ends by a transverse bar 31 (FIG. 4) and by two spaced transverse bars 32 adjacent their lower ends and mounted on a bearing block 33 having bearing engagement with the insides of the legs 17 of the supporting frame structure 13. The bearing block 33 has a pair of headed pins or studs 35 extending outwardly therefrom. The shanks of the studs fit along the slot 25 for movement therealong while heads 36 of said studs have slidable engagement with the outer sides of the legs 17 of said supporting frame structure 13.

The legs 17 of the angle irons are connected together at their upper ends by a channel-like member 37 accommodating the shanks of the studs 35 to be inserted between the legs 17 of said angle irons and slidably moved therealong. The legs 17 are further connected together by a transverse bar 39 adjacent the lower end of said supporting frame structure and forming a stop to limit downward movement of the slide 26. The facing angle irons are also connected together at their lower ends by the usual cradle as indicated by reference numeral 40 and formed to generally conform to and engage the wall of a drum or barrel to be lifted.

The slide 26 is adjustably held in position along the supporting frame structure 13 to position the gripping attachments 19 to grip a barrel or drum of a selected height by a locking pin 41 extending through aligned apertured portions 43 in the slide and through selected aligned apertured portions 44 in the legs 16 of the angle irons. The locking pin 41 may have a right-angled gripping portion adapted to be gripped by the hand and extending from one end. The opposite end of said locking pin may be beveled, as indicated by reference numeral 46. A conventional cotter pin 47 may lock the pin to said legs 16 and slide 26, to hold said slide in a selected position.

Referring now to the universal support for the gripping attachments 19 on the slide, two pairs of generally parallel links 48 and 49 are pivotally connected to the insides of the parallel plates 30 of the slide on pivot pins 50 and 51 respectively. The upper link is slightly longer than the lower link to tilt the drum towards the cradle 40, to engage said cradle.

The links 48 and 49 are pivotally connected at their outer ends to a universal body 53 on pivot pins 48$^a$ and 49$^a$ respectively. Said pivot pins 48$^a$ and 49$^a$ extend through upper and lower pivot blocks 54 and 55 respectively. Said pivot blocks 54 and 55 extend beneath upper and lower legs 56 and 57 respectively of a yoke-like structure 58 extending from said universal body toward the slide 26. Said pivot pins 48$^a$ and 49$^a$ extend through said bearing blocks and a pivot pin 60 which pivotally mounts the universal body for movement about the vertical axis of said pivot pin 60.

The pivot pin 60 is held in position by a locking pin 60$^a$ abutting a washer 60$^b$, which in turn abuts the top surface of the lower leg 57 of the yoke-like structure 58.

Figure 4:
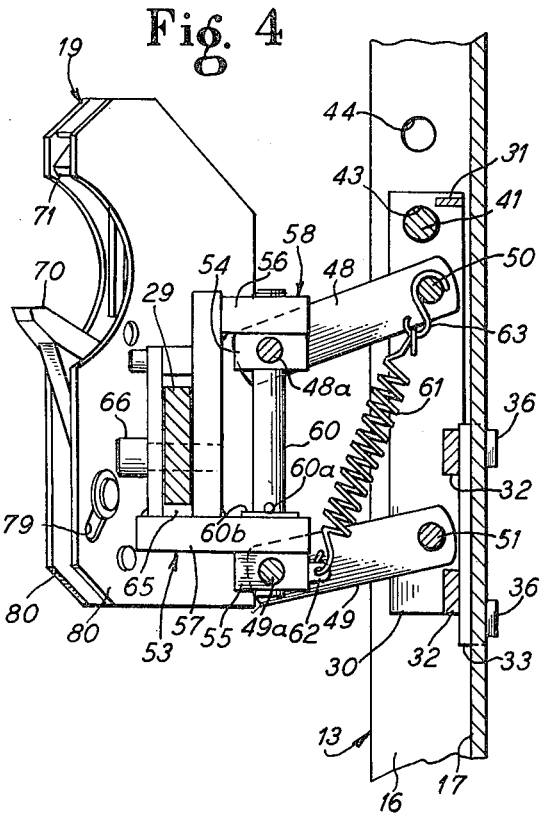
FIG. 4 is a sectional view taken substantially along line IV—IV of FIG. 3.
Figure 5:
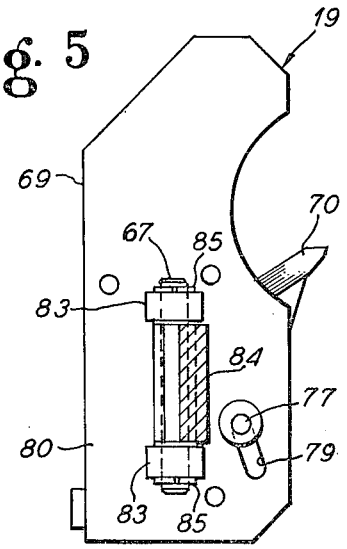
FIG. 5 is a sectional view taken substantially along line V—V of FIG. 2 and illustrating the pivotal mounting of a gripping attachment on its cross bar.

The links 48 and 49 and universal body 53 are biased in the upright positions shown in FIG. 4 by a tension spring 61 hooked at one end to an eye 62 extending from the pivot block 55 toward the slide 26 and hooked at its opposite end to a hood 63 hooked about the pivot pin 50.

The universal body 53 has a slot 65 extending thereacross for receiving the transverse bar 29. The transverse bar 29 is pivoted to said slot on the shank of a recessed cap screw 66 to accommodate movement of said transverse bar about the axis of said shank and accommodate automatic adjustment of the gripping attachments 19 to conform to the bead of a drum to be picked up. The transverse bar 29 is thus movable about the axis of the cap screw 66 and the pivot pin 60 for limited pivotal movement about both horizontal and vertical axes.

The universal body 53 and cap screw 66 thus accommodate the gripping attachments 19 to conform to beads extending about the top edges of drums or barrels of various forms and to drums or barrels which may rest on an uneven surface, and thereby enable the drums or barrels to be readily lifted without damaging the beads thereof. The gripping attachments 19 are further pivotally movable about the axes of vertical pivot pins 67, at opposite ends of the transverse bar 29 to further accommodate the gripping attachments to conform to the bead of a drum, in which the periphery of the drum may not be uniform and the bead thereof may also vary in uniformity and to drums of varying diameters.

Figure 6:
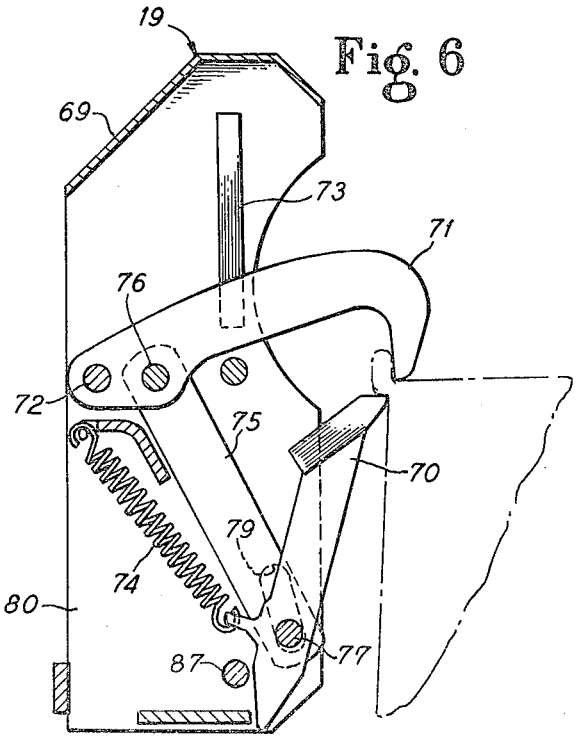
FIG. 6 is a detailed view of the gripping attachment of FIG. 4 showing the jaws in gripping engagement beneath and within the bead of a drum.

The gripping attachments 19 are conventional and each include a casing 69 for a lower gripping jaw 70 adapted to grip beneath the bead of a drum or barrel, and an upper gripping jaw 71 adapted to grip within the bead of a drum. The gripping jaws 70 and 71 and the casings 69 therefor are similar to those shown in the patent to John F. E. Ericson No. 2,698,107, dated Dec. 28, 1954, so need not herein be described in detail, except to point out a few features to clarify the operation of the gripping jaws. As shown in FIGS. 3 and 6, each casing 69 has an upper gripping jaw 71 pivoted thereto on a pivot pin 72 and retained from lateral movement with respect to the insides of said casing by rubrails 73 (FIG. 6). The lower gripping jaw 70 is extended relative to said casing by a tension spring 74 and is connected with the upper jaw 71 by a link 75 pivotally connected to said jaw adjacent the pivot pin 72, on a pivot pin 76. A pivot pin 77, pivotally connecting the link 75 to the lower gripping jaw 70, is slidably guided at its ends in angular slots 79 formed in side plates 80 of the casing 69. The spring 74 biases the lower gripping jaw 70 outwardly of the casing 69 in the position shown in FIGS. 3 and 4 and the upper gripping jaw 71 in the retracted position shown in these figures. Bringing a drum or barrel into engagement with the lower jaw 70 will thus retract said jaw into the position shown in FIG. 6 and extend the jaw 71 about the axis of the pivot pin 72 into engagement with the inside of the bead of the drum or barrel to be picked up.

Referring to the mounting of the gripping attachments 19 to opposite ends of the transverse bar 29, each casing 69 has an inner side wall 80 having a pair of parallel spaced lugs 83 extending therefrom for engaging and forming supports for the upper and lower ends of the pivot pins 67. The pivot pins 67 fit through boss-like portions 84 at opposite ends of the transverse bar 29 to form firm pivotal supports for said pins. Snap-rings 85, snapped to grooved portions at opposite ends of said pivot pins, may hold said pivot pins in position.

Pivotal movement of the gripping attachments in inward or outward directions is limited by stop plates 86, shown in FIG. 2 as extending diagonally across the bar 29 inwardly of the lugs 83 and generally parallel to the inner faces of said lugs 83 when the gripping attachments 19 are in a normal position, to come into gripping engagement with the bead of a drum. The plates 86 prevent outer movement of the gripping attachments 19 out of position to engage the bead of drum and accommodate limited movement of the gripping attachments about the axes of the pivot pins 67.

When the casings 69 of the gripping attachments 19 are in the position shown in FIG. 2 and the gripping attachments are elevated to being the lower jaw 70 beneath the bead of a drum as shown in FIG. 6, with the gripping attachments in the extended position shown in FIG. 4, the casings 69 of the gripping attachments are retracted as the lower jaws 70 come into position to engage beneath the bead of the drum and are angularly positioned to generally conform to the periphery and bead of the drum by movement of the casings about the axes of the pivot pins 60, 67 and shank of the stud 66. This is attained by movement of the lift truck toward the drum to engage the projecting ends of the casings 69 therewith. The lifting mechanism of the truck is then operated to lift the lift bar 12, supporting frame structure 13 and gripping attachments 19.

When the noses of the jaw casings 69 clear the bead of the drum, the tension spring 61 will extend the casing and bring the lower jaw 70 into position to engage beneath the bead of the drum. Continued upward movement of the gripping attachments will then effect movement of the upper jaw 71 into engagement with the inside of the bead of the drum, the casings and jaws conforming to the outer periphery of the drum and the beads extending along the top of the drum, by the universal movement afforded by the transverse bar 29 and the pivotal connections of the casings 69 thereto within the limits of said universal connection and the stop plates 86. Continued lifting movement of the gripping attachments will move the lower jaw outwardly toward the upper jaw and positively grip and lift the drum. As the drum is lifted from the ground or floor, the springs 74 will yield until engagement of the lower end of each lower jaw 70 with a stop 87 and engagement of the pin 76 with the lower end of the aligned slots 79 in the plates 80. The drum engaging the cradle 40 at its lower end and held from inward movement with respect to the jaws by said cradle may thus be transported from place to place in a generally vertical position and lifted for stacking on top of other drums. The conforming of the gripping attachments to the periphery of the drum and the gripping and release of the gripping attachments from the bead of the drum may thus be attained with no attention from the operator, except by operating the truck to engage the drum with the jaw casings 69 and at the same time, operating the lift mechanism of the truck to elevate or lower the gripping attachments.

It should be understood that in releasing the gripping attachments from the drum, it is only necessary to set the drum on top of another drum or on the ground or floor on which the drum being handled is to be stacked, by lowering movement of the frame support 13 until the weight of the drum is relieved from the lower jaws 70. As the truck moves the gripping attachments away from the drum, the tension springs 61 extend the casings 69, while the tension springs 74 extend the lower jaws 70 from the casings 69 and retract the upper jaws 71 within said casings.

It may further be understood that the gripping attachments are conformed to the peripheries of drums of varying diameters merely by engagement of the drum to be lifted with the jaws and casings 69, and once the gripping attachments are in the proper vertical positions along the supporting frame structure 13, to conform to the height of a drum to be lifted, no further attention is required to conform the casings to drums of varying diameters and contours and beads of varying forms, and with the universal pivotal supports for the casings of the gripping attachments, the possibility of tearing the beads of the drum to be picked up by improper positioning of the gripping attachments relative to the beads of the drum is eliminated.

I claim as my invention:

1. For use with a lift rruck having a vertically movable mast for gripping and lifting drums, each having a bead at each end thereof and extending thereabout, a pair of drum gripping attachments each having a lower gripping jaw for gripping beneath the top bead of a drum and an upper gripping jaw cooperating with said lower gripping jaw and gripping within the top bead of a drum, transverse support means adjustably mounting said drum gripping attachments on said mast in laterally spaced relation with respect to each other for movement about a horizontal axis extending between said gripping attachments to conform to a drum having a non-uniform bead and for vertical movement with said mast, and means pivotally mounting said gripping attachments at opposite ends of said transverse support means for movement about parallel vertical axes to conform to the circumferential surfaces of drums of various diameters.

2. The device of claim 1 wherein means are provided on said transverse support means for limiting pivotal movement of said gripping attachments relative to said transverse support means.

3. The devide of claim 2 wherein said transverse support means is also pivotally movable about a vertical axis intermediate the ends of said transverse support means and perpendicular to the axes of mounting said gripping attachments on said transverse support means.

4. A drum handling attachment for lift trucks and the like having a vertically movable mast, a pair of laterally spaced drum gripping attachments, each having a lower gripping jaw for gripping beneath the top bead of a drum and an upper gripping jaw cooperating with said lower gripping jaw and gripping within the top bead of a drum, a transverse support member carried by said vertically movable mast and having a drum gripping attachment at each end thereof, a vertical frame structure having a cradle at its lower end and extending from said mast equal distances in opposite directions to engage the wall of a drum to be lifted, a slide adjustable along said vertical frame structure, means retaining said slide in position on said vertical frame structure, said transverse support member extending transversely of said slide equal distances in opposite directions, a pair of generally parallel links mounting said transverse support member on said slide, one of said gripping attachments being mounted at each end of said transverse support member for pivotal movement about a vertical axis, means yieldably biasing said transverse support member and gripping attachments in outwardly extended relation with respect to said vertical frame structure and said gripping attachments in outwardly extended relation with respect to said slide and to yield toward said slide upon engagement of said gripping attachments with the periphery of a drum, and the means mounting said transverse support member on said parallel links comprising a universal support.

5. The apparatus of claim 4 wherein the transverse support member is a bar forming a part of said universal support and mounted at its transverse center for limited movement about a horizontal axis.

6. The apparatus of claim 5 wherein a vertical pivot pin mounts said universal support between said parallel links, and a transversely extending slot forms a mounting for said bar.

7. The gripping means of claim 5 wherein stop means extends across said each end of said bar and bosses at the outer ends of said bar form mountings for said gripping attachments.

8. The gripping means of claim 4 wherein the mounting of said universal support on said slide includes two pairs of generally parallel links.

* * * * *